US005361467A

United States Patent [19]

Jaeger et al.

[11] Patent Number: 5,361,467

[45] Date of Patent: Nov. 8, 1994

[54] DROP WIRE HANDLING APPARATUS FOR WARP YARN DRAWING-IN MACHINE

[75] Inventors: Silvio Jaeger, Mauren; Hans Wilhelm, Chur, both of Switzerland

[73] Assignee: Zellweger Uster AG, Wilstrasse, Switzerland

[21] Appl. No.: 822,908

[22] Filed: Jan. 21, 1992

[30] Foreign Application Priority Data

Jan. 22, 1991 [CH] Switzerland ..... 00181/91

[51] Int. Cl.[5] ..... D03J 1/14

[52] U.S. Cl. ..... 28/205; 28/208

[58] Field of Search ..... 28/205, 201, 206, 207, 28/203.1, 202, 204, 208; 139/349, 350, 351

[56] References Cited

U.S. PATENT DOCUMENTS

| | | | |
|---|---|---|---|
| 1,589,587 | 6/1926 | Colman | 28/205 |
| 2,230,494 | 2/1939 | Kieke | 28/205 |
| 3,103,056 | 9/1963 | Wieneke . | |
| 4,017,948 | 4/1977 | Voglebacher | 28/205 |
| 4,038,729 | 8/1977 | Townsend . | |
| 4,047,270 | 9/1977 | John | 28/205 |
| 4,543,696 | 10/1985 | John et al. | 28/206 |
| 4,891,871 | 1/1990 | Tachibana | 28/205 |

FOREIGN PATENT DOCUMENTS

| | | | |
|---|---|---|---|
| 298616 | 1/1989 | European Pat. Off. | 28/206 |
| 298696 | 1/1989 | European Pat. Off. | 28/206 |
| 688493 | 2/1940 | Germany . | |
| 3193954 | 8/1991 | Japan | 28/204 |
| 663826 | 12/1951 | United Kingdom . | |
| 2109426 | 6/1983 | United Kingdom | 28/207 |
| 2117419 | 10/1983 | United Kingdom | 28/202 |

OTHER PUBLICATIONS

European Search Report No. 0496232A1.

*Primary Examiner*—Clifford D. Crowder
*Assistant Examiner*—Larry O. Worrell, Jr.
*Attorney, Agent, or Firm*—Burns, Doane, Swecker & Mathis

[57] ABSTRACT

Apparatus for handling the drop wires after the warp-yarn draw-in has taken place contains rail-like carrier members (12) provided for lining up the drop wires. Threaded spindles (34) are arranged on top parts of the carrier members in position to engage the drop wires on the carrier members. The threaded spindles (34) are for displacing the drop wires in the longitudinal direction of the carrier members. The displacement of the drop wires on the carrier members is thereby automated, and the stress on the warp yarns is kept as low as possible.

15 Claims, 4 Drawing Sheets

DROP WIRE HANDLING APPARATUS FOR WARP YARN DRAWING-IN MACHINE

FIELD OF THE INVENTION

This invention relates to drawing-in machines for preparing warp yarn systems for use in weaving machines. It is concerned particularly with means for handling the drop wires after they have been successively threaded with warp yarns and lining up the threaded drop wires on rail like carrier members in assemblies appropriate for harnesses to be installed later in the weaving machines.

BACKGROUND

In the previously known drawing-in machine sold by Zellweger Uster A. G. under the designation USTER DELTA (USTER being a registered trade mark of Zellweger Uster AG), the individual drop wires were transferred, after having been threaded with a warp yarn, to carrier members by a knock-out lever with yarn knock-out arms at the same time pressing on the drawn-in warp yarn and assisting the effect of the knock-out lever. The particular drop wire just transferred to a carrier member thereby displaced the drop wires already lined up on this carrier, and especially where relatively long drop-wire stacks were concerned this displacement had to be assisted from time to time by manual actions of the attendant.

This does not represent the best possible result, in view of the aim of achieving as comprehensive an automation of the drawing-in operation as possible, and it also leads to a relatively high stress on the warp yarns.

SUMMARY OF THE INVENTION

In accordance with an aspect of the present invitation, means are provided by which the handling of the drop wires after the draw-in can be automated and which guarantees as protective a treatment of the warp yarns as possible.

In an embodiment of the invention, the drawing-in machine is provided with means for displacing the drop wires in the longitudinal direction of the carrier members. As a result, the displacement of the drop wires on the carrier members takes place independently of forces incident to the transfer of a newly threaded drop wire to the carrier members. The drop wires already on the carrier members are displaced along the lengths of the carrier members by the driving force of the means included in the apparatus itself. This allows the necessary displacement of the drop wires to take place reliably and without manual actions. Also, there is a reduction in the stress on the warp yarns.

In a preferred embodiment the means for displacing the drop wires are arranged on the carrier members. This preferred embodiment permits a simple version of the device according to the invention which is designed especially advantageously if, as is especially preferred, the said means are formed by a threaded spindle which is arranged on the upper edge of each carrier member carrying the drop wires and which can be driven rotatably about its longitudinal axis.

BRIEF DESCRIPTION OF THE DRAWINGS

The invention is explained in more detail below by means of an exemplary embodiment and the drawings, in which.

DETAILED DESCRIPTION OF THE PREFERRED EMBODIMENTS

Figure 1:
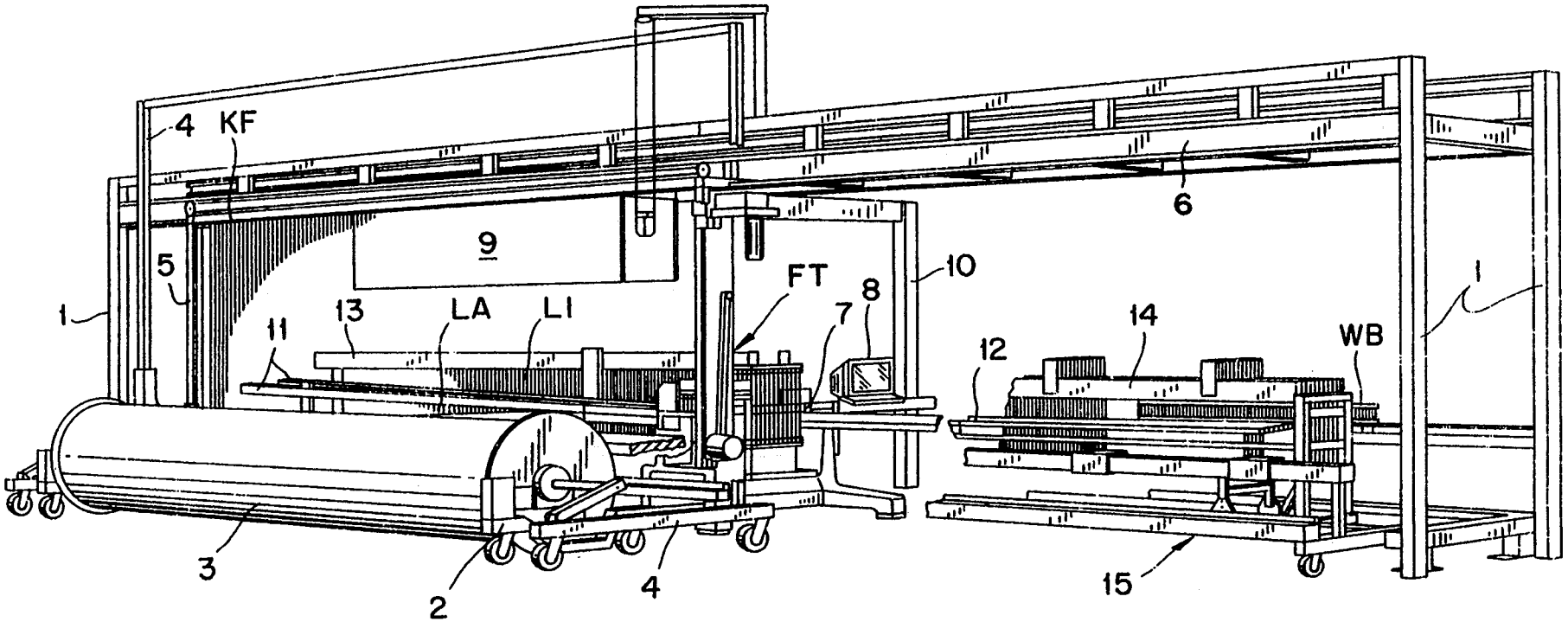
FIG. 1 is a general perspective representation of a drawing-in machine according to the invention.

According to FIG. 1, the drawing-in machine includes a mounting stand 1 and various subassemblies arranged in this mounting stand 1, each of which subassemblies represents a functional module. A warp-beam truck 2 with a warp beam 3 arranged thereon can be recognized in front of the mounting stand 1. The warp-beam truck 2 is connected to a so-called lifting device 4 for receiving and holding a frame 5, on which the warp threads KF are clamped. This clamping is effected before the actual drawing-in and at a location separate from the drawing-in machine, the frame 5 being positioned at the bottom end of the lifting device 4 directly next to the warp beam 3. For the drawing-in, the warp-beam truck 2 together with warp beam 3 and lifting device 4 is moved to the so-called setting-up side of the drawing-in machine and the frame 5 is lifted up-wards by the lifting device 4 and hung in the mounting stand 1, where it then assumes the position shown. The frame 5 is hung in a transport apparatus (not shown) mounted on the front longitudinal girder 6 of the mounting stand 1.

During the drawing-in process, the frame 5 and the lifting device 4 together with the warp-beam truck 2 and the warp beam 3 are displaced from left to right in the longitudinal direction of the girder 6. During this displacement, the warp threads KF are directed past a thread-separating stage KF which has an apparatus for selecting the warp threads and for cutting off the selected warp threads KF as well as an apparatus PR for presenting the cut-off warp threads to a drawing-in needle 7, which forms a component of the so-called draw-in module. The selecting apparatus used in the warp tying machine USTER TOPMATIC can be used, for example, for the selection of the warp threads.

Next to the drawing-in needle 7 can be recognized a video display unit 8, which belongs to an operating station and serves to display machine functions and malfunctions and to input data. The operating station, which forms part of a so-called programming module, also contains an input stage for the manual input of certain functions, such as e.g. creep motion, start/stop, repetition of operations, and the like. The drawing-in machine is controlled by a control module containing a control computer and arranged in a control box 9. Apart from the control computer, this control box contains a module computer for every so-called main module, the individual module computers being controlled and monitored by the control computer. The main modules, apart from the modules already mentioned—(-draw-in module, yarn module, control module and programming module), are the heald—, drop-wire—, and reed module.

The thread-separating stage FT, which presents the warp threads KF to be drawn in to the drawing-in needle 7, and the path of movement of the drawing-in needle 7, which runs vertically to the plane of the clamped warp threads KF, define a plane in the area of a support 10 forming part of the mounting stand 1 which plane separates the setting-up side already mentioned from the so-called taking-down side. The warp threads and the individual elements into which the warp threads are to be drawn in are fed at the setting-up side, and the so-called harness (healds, drop wires and reed) together with the drawn-in warp threads can be removed at the taking-down side. When all warp threads KF are drawn in and the frame 5 is empty, the latter, together with the lifting device 4, the warp beam truck 2 and the warp beam 3, is located on the taking-down side and can be removed from the mounting stand.

Arranged directly behind the plane of the warp threads KF are the warp-stop-motion drop wires LA, behind the latter the healds LI and further to the rear the reed. The drop wires LA are stacked in hand magazines and the full hand magazines are hung in sloping feed rails 11, on which they are transported to the right towards the drawing-in needle 7 where they are separated and moved into the drawing-in position. Once drawing-in is complete, the drop wires LA pass to on drop-wire supporting rails 12 on the taking-down side.

The healds LI are lined up on rails 13 and shifted on the latter to a separating stage. The healds LI are then moved individually into their drawing-in position and, once drawing-in is complete, are distributed over the corresponding heald shafts 14 on the taking-down side. The reed is likewise moved step-by-step past the drawing-in needle 7, the corresponding reed gap being opened for the drawing-in. After the drawing-in, the reed is likewise located on the taking-down side. A part of the reed WB can be recognized to the right next to the heald shafts 14. This representation is to be understood purely as an illustration, since the reed, at the position shown of the frame 5, is of course located on the setting-up side.

As further apparent from the figure, a so-called harness truck 15 is provided on the taking-down side. This harness truck 15, together with the drop-wire supporting rails 12, fixed thereon, heald shafts 14 and holder for the reed, is pushed into the mounting stand 1 into the position shown and, after the drawing-in, carries the harness having the drawn-in warp threads KF. At this moment, the warp-beam truck 2 together with the warp-beam 3 is located directly in front of the harness truck 15. By means of the lifting device 4, the harness is now reloaded from the harness truck 15 into the warp-beam truck 2, which then carries the warp beam 3 and the drawn-in harness and can be moved to the relevant weaving machine or into an intermediate store.

The individual main modules of the drawing-in machine are composed of submodules which are in each case provided for certain functions. Reference is made in this connection to Int. Application No. PCT/CH90/00227 and to U.S. application Ser. No. 07/739,475 now U.S. Pat. No. 5,274,894, filed Aug. 2, 1991, the disclosures of which are incorporated herein in their entireties.

The submodule for handling the drop wires after the warp-yarn draw-in has taken place, the so-called drop-wire conveyor device, will now be described below. This device takes over the drop wires with the drawn-in warp yarns and displaces them on the drop-wire carrier rails 12. As can be taken from FIG. 1, the drop-wire conveyor device is arranged on a harness truck 15 consisting essentially of a frame which is equipped with wheels and which carries, in addition to the drop-wire conveyor device, also a heald conveyor device for conveying the drawn-in healds on the heald shafts 14 and a mounting for the weaving reed WB.

Figure 2A:
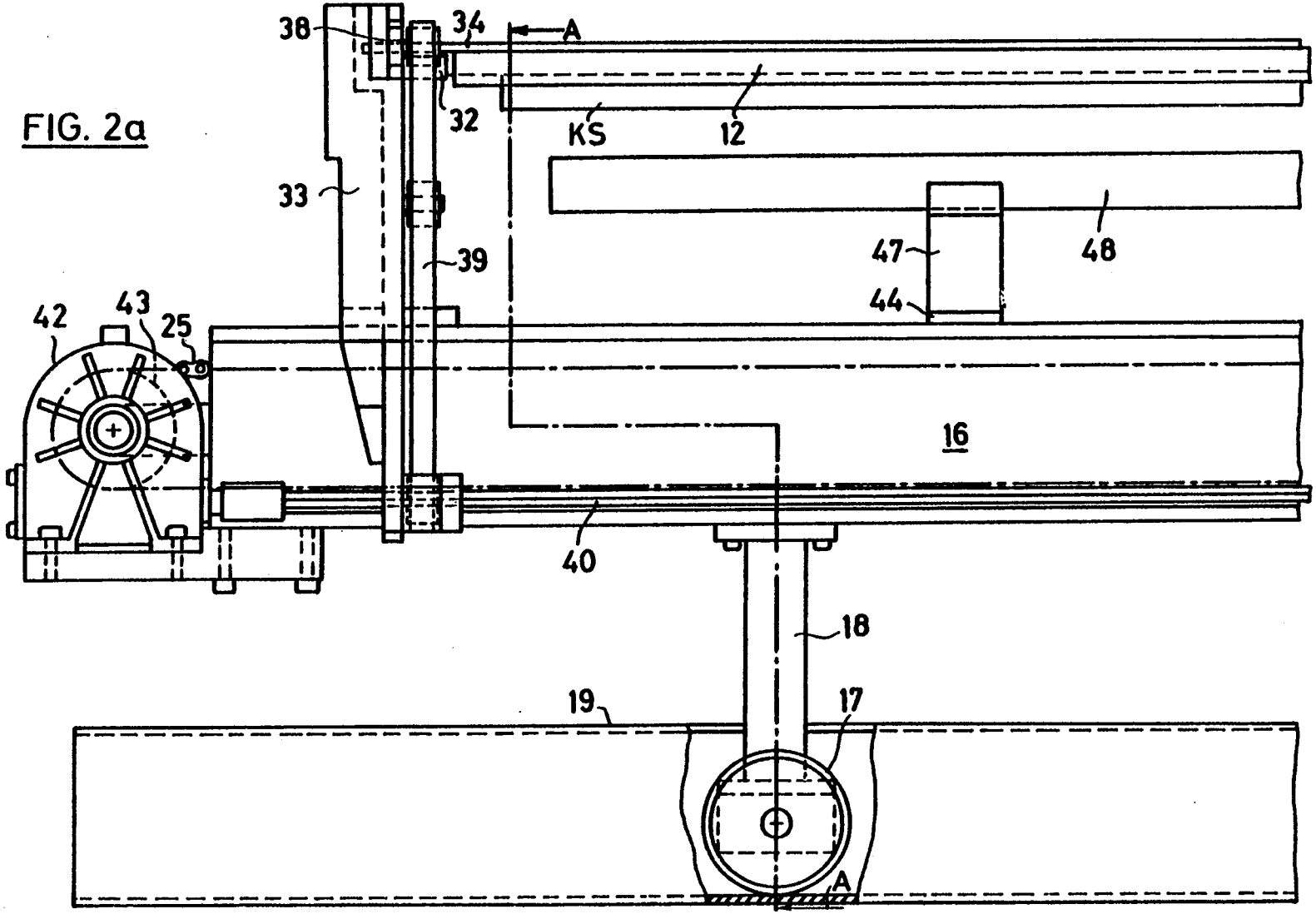
FIGS. 2*a* and 2*b* are elevational representations taken from the rear of the machine of FIG. 1 and showing respectively the opposite end portions of the device for handling the drop wires.
Figures 2B, 5:
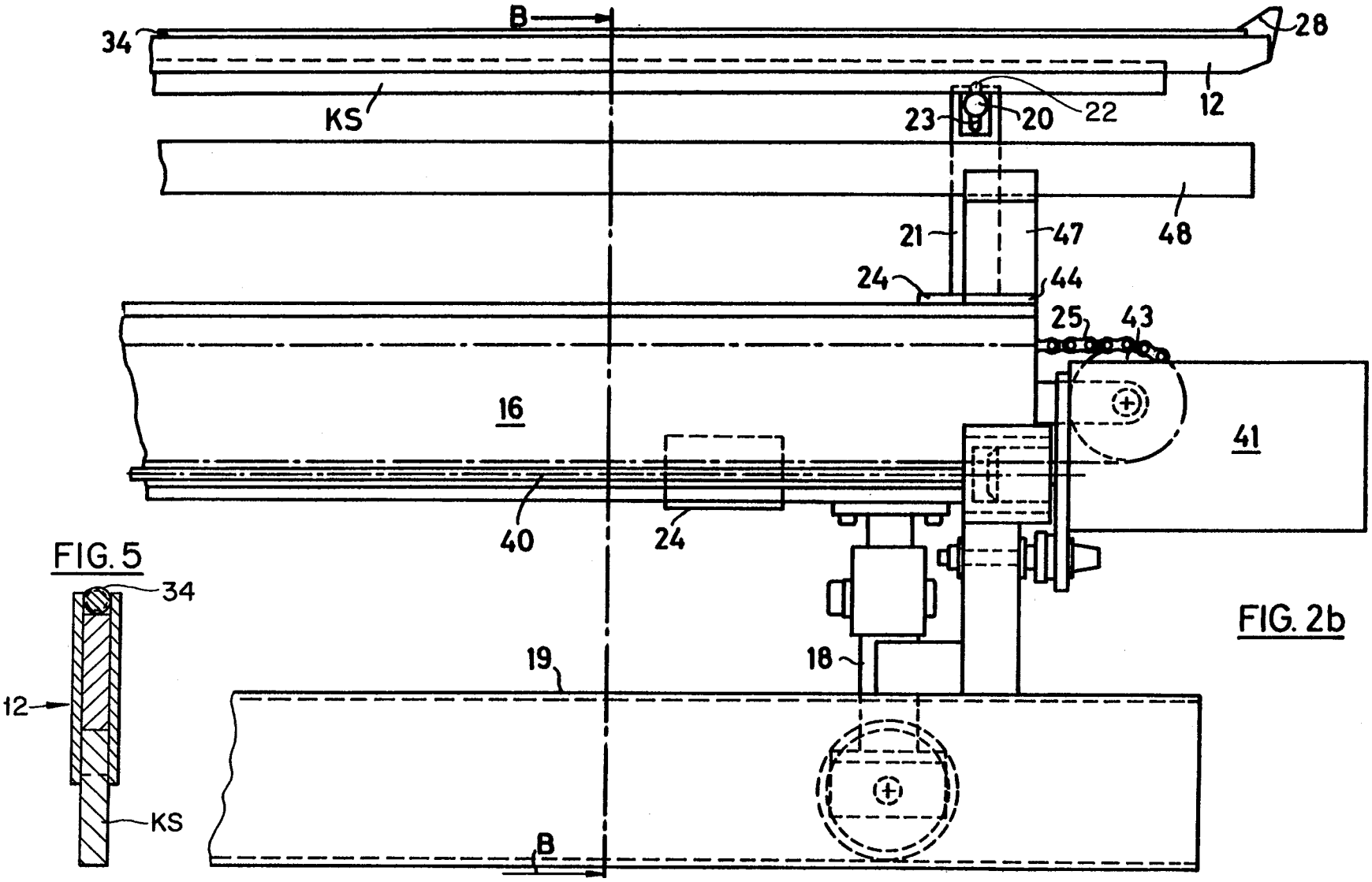
FIG. 4 and FIG. 5 are a section along the line B—B of FIG. 2*b.*
Figure 3:
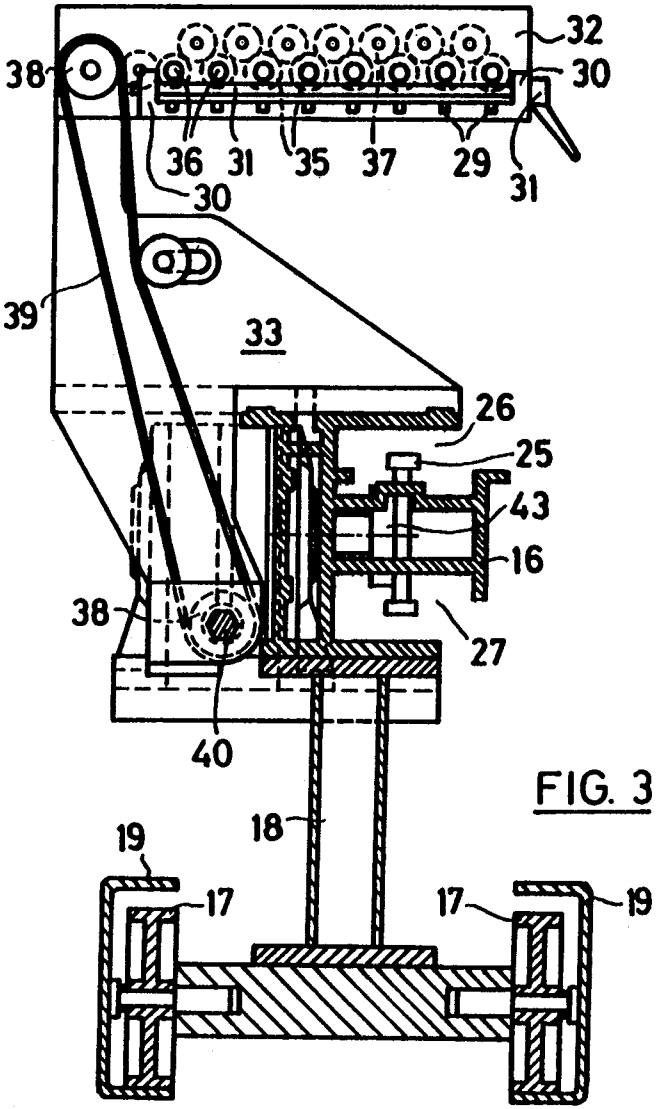
FIG. 3 is a section along the line A—A of FIG. 2*a;*.

The drop-wire conveyor device is illustrated in FIGS. 2 to 4, FIGS. 2*a* and 2*b* showing respectively a view in the region of the two end faces of the elongate device, specifically from the rear, that is to say as seen from the weaving reed WB in relation to FIG. 1. FIG. 2*a* shows the outer end of the drop-wire conveyor device on the right in FIG. 1 and FIG. 2*b* the inner end on the left in FIG. 1. This inner end is the so-called fill-up side, that is to say the side on which the drop-wire conveyor device takes over the drawn-in drop wires from the drop-wire distribution part module described in Int. Application No. PCT/CH91/00190. The drawn-in drop wires are then to be distributed over the entire length of the drop-wire carrier rails, and these are to be held so that continuous transport is possible over the entire carrier-rail length. FIG. 3 shows a section along the line A—A of FIG. 2*a* and FIG. 4 a section along the line B—B of FIG. 2*b*; in FIG. 3 the drop-wire carrier rails being omitted for the sake of greater clarity. The scale in each case is approximately 1:3.5. It may also be pointed out that FIGS. 2*a* and 2*b* show only a small part of the drop-wire conveyor device, the total length of which amounts to approximately 4.5 meters.

The drop-wire conveyor device includes a sectional support or bearer 16 for the various holding and actuating members yet to be described. The support unit or bearer 16 is mounted on bearing blocks 18 equipped with transport wheels 17 and extends over generally the entire length of the taking-down side of the machine shown in FIG. 1 to the right of the drawing in station. The transport wheels 17 are guided in rails 19 which are mounted on the harness truck 15 (FIG. 1).

The drop-wire carrier rails 12 are placed onto horizontal carrier bars 20 which are inserted into vertical carrier bolts 21 and which have a round cross-section with a radially projecting beard-like comb 22. This comb contains equally spaced guide slots for the drop-wire carrier rails. As represented, there are eight such slots for eight drop-wire carrier rails altogether. The carrier bars 20 are equipped with a handle and are held releasably in the carrier bolt 21. The carrier bar 20 is fixed in the position shown in FIG. 4, and to pull it out of the carrier bolt 21 it has to be rotated through 180°, in which position the comb 22 can pass through a corresponding groove 23 in the carrier bolt 21.

The carrier bolts 21 are themselves inserted at their lower end into carrier arms 24 which are in engagement with a transport chain 25 and which are movable by this along the sectional bearer 16. The carrier arms 24, during their transport, are guided in the sectional bearer 16 which for this purpose has an upper and a lower guide channel 26 and 27, in which the corresponding strand of the transport chain 25 runs. The carrier arms 24 driven by the transport chain 25 thus execute a movement along a closed path with a working stroke and an idle stroke. During their working stroke, the carrier arms 24 are loaded with the carrier bolts 21, carrier bars 20 and drop-wire carrier rails 12 and run in the upper guide channel 26 outwards from the fill-up side, specifically at a speed which corresponds to the speed of growth of the drop-wire stack on the drop-wire carrier rails 12. A number of carrier arms 24 are provided over the length of the sectional bearer 16; their movement is necessary to allow a continuous transport of the drop wires LA along the drop-wire carrier rails 12.

The carrier arms 24, during their movement, slide along on the drop-wire carrier rails 12, leave these and finally come to their outer reversal point, where they change from the upper guide channel 26 to the lower guide channel 27. Before this change and after they leave the region of the drop-wire carrier rails 12, the carrier bolts 21 and the carrier bars 20 are removed from the carrier arms 24, and the carrier arms 24 run in the lower guide channel 27 back unloaded to the fill-up side, where the carrier bolts 21 together with the carrier bar 20 are then inserted once again into the carrier arms 24. Should the removal of the carrier bolts 21 together with the carrier bars 20 from the carrier arms 24 in due time be forgotten or overlooked, during the change of the carrier arms 24 the carrier bolts 21 automatically fall out of these from the upper guide channel to the lower.

The drop-wire carrier rails 12, at their end on the fill-up side, have an oblique entry part 28, on which the drop wires slide onto the carrier rails. At their other end, the drop-wire carrier rails 12 are guided in guide slots 29 of a holding web 30 and are fixed to the holding web by means of a retaining peg 31 passing through corresponding bores of the drop-wire carrier rails. This forms a projecting support on the upper crossbar 32 of a rear wall which is fixed to the sectional bearer 16 and on which there are, moreover, drive means for displacing the drop wires on the drop-wire carrier rails 12.

At this point, it is appropriate to note particularly how the support system for the carrier rails 12 accommodates the desired movements of the drop wires. The aperture at the upper portion of each drop wire may surround a carrier rail 12, as depicted (in part by dash lines) in FIG. 4, the drop wire having been inserted onto the free and unobstructed entrance end portion (FIG. 2*b*) of the carrier rail 12. As the drop wire is moved along the length of its carrier rail 12 (to the left in FIGS. 2*b* and 2*a*) its path is not closed off by support structure for the long carrier rail, because the support units made up of the carrier bars 20 also move relative to the long carrier rail 12 in the same direction and at the same rate.

The individual carrier rails are of sandwich-like construction and consist of a core 12*a* and of two side walls 12*b* projecting beyond the core at the top and bottom, so that above and below the rail constituting the core is formed a respective U-shaped groove extending over the length of the drop-wire carrier rail 12. Held in the lower groove is the actual contact or sawtooth rail KS for the warp stop motion, onto which the drop wires are lined up, after drawing in, simply by pulling off the drop-wire carrier rail 12 in front of the contact or sawtooth rail. This makes it possible, for the first time, on the drawing-in machine to line up the drop wires onto the warp stop motion rails as it were directly, without an additional operation being needed for this. It will be understood of course that the sawtooth rail KS becomes a functional part of the warp stop motion in the weaving machine, so that the pulling off of the carrier rail 12 in front of the sawtooth rail KS must take place after the drawing-in machine has completed its work on a particular weaving machine harness and before the installation of that harness in the weaving machine has been fully accomplished.

Mounted in the upper groove of the drop-wire carrier rails 12 is a threaded spindle 34 which is rotatable about its longitudinal axis and which serves as means for displacing the drop wires along the drop-wire carrier rails 12, in that, during the rotation of the threaded spindle 34, the drop wires are displaced by its thread on which they are lined up. As the aperture of a newly threaded drop wire is inserted over the entry part 28 at the free end portion of a carrier rail 12, the drop wire descends so that the upper margin of the aperture in the drop wire will drop into the space between two portions of the thread on spindle 34 exposed at the top of the rail 12. Rotation of the spindle 34 then causes its thread to push against an adjacent portion of the drop wire to shift it longitudinally along the length of its carrier rail 12. This pushing action continues throughout the travel of the drop wire over the long carrier 12, because the thread on the spindle 34 continues throughout its length. Subsequently, drawn-in drop wires also will be with the thread on the spindle after they are inserted over the free end of the carrier rail, and each of the drop wires on the rail will be pushed along longitudinally by the thread as the spindle rotates.

The threaded spindle 34 is driven via gear wheels 35 having a chuck 36 for receiving the end portion of each threaded spindle 34. For this purpose, such end portion is made smooth. The chuck 36 operates in the conventional way to provide a releasable coupling through which rotational forces may be transmitted to the spindle 34.

To correspond to the eight possible drop-wire carrier rails 12, there are eight gear wheels 35 which are mounted on the said upper crossbar 32 of the rear wall 33 and which are drive-coupled to one another via intermediate gear wheels 37. By the use of the intermediate gear wheels 37, all the gear wheels 35 have the same direction of rotation.

With this construction, detachable connection means for both the carrier rails 12 and the threaded spindles 34 are provided at that end portion (FIG. 2*a*) of the system which is opposite to the end adjacent the station where the warp yarns are threaded through the eyes of the individual drop wires. Moreover, these connections are releasable so that the rails 12 and the threaded spindles 34 may be inserted and withdrawn as desired. In setting up the drawing-in machine, a set of the rails 12 will be inserted into the slots 29 of the holding web 30 and engaged by the retaining peg 31 to fix them in place for a harness preparation operation, and the smooth ends of the several spindles 34 will be engaged by the chucks 36 so that they may be rotated in the desired manner as the harness preparation operation is being carried out. After all of the weaving machine components have been threaded with warp yarns and moved to their designated places at the right side of FIG. 1, the spindles 34 may be released by reverse action of the chucks 36 and the rails 12 may be released by withdrawal of the retaining peg 31 so as to permit removal of the completed weaving harness.

The gear wheels 35 are themselves driven via toothed-belt wheels 38 and a toothed belt 39 by a shaft 40 which extends along the sectional bearer 16 and which is connected to a drive motor 41 (FIG. 2*b*) at its end located on the fill-up side of the drop-wire conveyor device and to a reversing gear 42 at its other end. This reversing gear itself drives a chain wheel 43 serving as a drive for the transport chain 25, so that both the conveyance of the drop wires on the drop-wire carrier rails 12 and the displacement of the members (carrier bars 20, carrier bolts 21, carrier arms 24) carrying the drop-wire carrier rails 12 are obtained by means of the motor 41. A second chain wheel 43 is arranged at the end of the drop-wire conveyor device on the fill-up side.

So that the drop-wire conveyor device can, on its fill-up side, be aligned exactly level with the drop-wire distribution part module, at this end it is made vertically adjustable in the bearing block 18. On the other hand, however, the motor 41 is connected firmly to the bearing block 18 and thus has a fixed level, with the result that height differences can occur between the end of the shaft 40 connected to the motor 41 and that driving the toothed belt 39. So that these can be compensated, the shaft 40 is made two-part, the two parts being connected to one another in an articulated manner, and the part connected to the motor 41 having a round cross-section and the other part a hexagonal cross-section.

Figure 4:
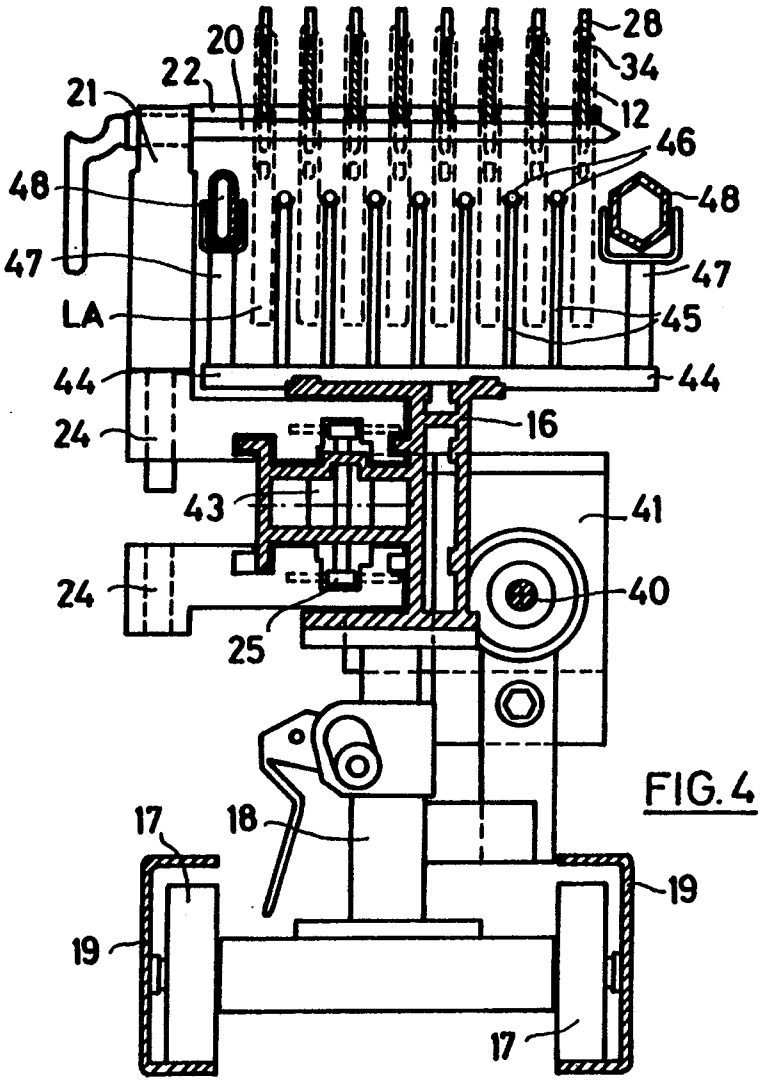

As can be taken from FIGS. 2*a*, 2*b* and 4, arranged on the sectional bearer 16 are a plurality of, preferably three or four holding rails 44 which are spaced from one another and on which are mounted holders 45 for separating rods 46 extending between the rows of drop wires. These serve for separating the drop wires LA of adjacent rows from one another and for preventing the possibility that these will come into mutual contact and catch in one another. The set together with the separating rods 46 is covered on the two longitudinal sides by a stable guard strip 48 which is likewise carried by holders 47 mounted on the holding rails 44 and which protects the sets of drop wires against external effects.

The drop-wire conveyor device described allows an automatic conveyance of the drop wires on the drop-wire carrier rails, whilst at the same time ensuring the most careful treatment of the warp yarns possible. Also, and for the first time, the invention allows the warp stopper rails KS to be loaded directly on the drawing-in machine. These sawtooth rails KS, which are to be functional parts of the loom warp stop motion, are brought into the required relationship with the apertures in the drop wires right in the drawing-in machine itself.

What is claimed is:

1. A warp yarn drawing-in machine having a support structure and a system for forming an assembly that includes an elongated carrier rail and drop wires which have warp yarns drawn therein and which have apertured portions disposed in generally surrounding relation to said carrier rail, said system comprising:

said carrier rail including one end portion that is releasably connected to said support structure and an opposite end portion for the positioning thereover one after another of the apertured postions of said drop wires;

drive means for contacting the drop wires on said rail and moving such drop wires along said rail toward said one end portion of said rail;

movable support means for supporting said rail from below said rail; and means for moving said support means relative to said rail in the same direction as said drop wires move along said rail to enable support of the rail without interfering with the movement of the drop wires along the rail.

2. A warp yarn drawing-in machine according to claim 1, wherein said drive means includes a threaded spindle rotatably mounted on said support structure and extending along a top side of said rail, said spindle being rotatable relative to said rail.

3. A warp yarn drawing-in machine according to claim 2, including a rotary chuck supported by said support structure for grasping an end portion of said threaded spindle to rotate said spindle.

4. A warp yarn drawing-in machine according to claim 1, wherein said carrier rail carries a warp stop motion rail over which said drop wires are positioned concurrently with their positioning onto said carrier rail.

5. Device for handling drop wires after a warp-yarn draw-in has taken place in a warp yarn drawing-in machine comprising carrier members for lining up the drop wires so that an apertured portion of the drop wires is disposed in generally surrounding relation to the carrier member and means for displacing the drop wires lengthwise along said carrier members, each of said carrier members having an upper edge and said means for displacing the drop wires including a plurality of threaded spindles, each spindle being arranged on an upper edge of a carrier member carrying the drop wires so that the threaded spindle passes through the apertured portion of drop wires carried on the carrier member, and means for rotating said spindles.

6. Device for handling drop wires in a warp yarn drawing-in machine after a warp-yarn draw-in has taken place, comprising carrier members for lining up the drop wires, and means for displacing the drop wires lengthwise along said carrier members, each of said carrier members having a lower edge portion along which is releasably received a warp stop motion rail that is to be used in a weaving machine.

7. Device according to claim 6, wherein said carrier members have U-shaped grooves on their upper and lower edges respectively for receiving said means for displacing the drop wires and said warp stop motion rail respectively.

8. Device for handling drop wires in a warp yarn drawing-in machine after a warp-yarn draw-in has taken place, comprising carrier members for lining up the drop wires, each of said carrier members having an upper edge, and means arranged along said carrier members for displacing the drop wires lengthwise along said carrier members, said means for displacing the drop wires including a plurality of threaded spindles one of which is arranged on the upper edge of each carrier member carrying the drop wires, each of the threaded spindles having an end portion projecting beyond the carrier members, and drive means formed by gear wheels connected to said projecting end portions of said threaded spindles and a drive for said gear wheels, said gear wheels being connected to one another via intermediate gear wheels, and said gear wheels and drive being arranged on a common carrier.

9. Device for handling drop wires in a warp yarn drawing-in machine after a warp-yarn draw-in has taken place, comprising carrier members for lining up the drop wires, means for displacing the drop wires lengthwise along said carrier members, holding means arranged displaceably along the carrier members for holding said carrier members, and means for displacing said holding means along said carrier members in synchronism with the displacement of said drop wires along said carrier members, said holding means comprising carrier bars which are oriented transversely relative to the carrier members and which are connected to a drive.

10. Device according to claim 9, wherein said drive of the carrier bars is formed by a transport chain which extends in the longitudinal direction of the carrier members and which is in engagement with fastening means for the carrier bars.

11. Device according to claim 10, wherein said fastening means for the carrier bars are guided in a support extending over the length of the carrier members, and wherein said transport chain is carried by chain wheels mounted on said support.

12. Device according to claim 11, wherein said support has elongate chambers through which the transport chain passes and which serve for guiding the fastening means for the carrier bars.

13. Device according to claim 12, including holding rails on said support, holders on said holding rails, and separating rods on said holders, said separating rods extending generally parallel to said carrier members in the spaces between the drop wires carried by the respective carrier members.

14. A warp drawing-in machine according to claim 3, comprising a plurality of carrier rails each having a threaded spindle, the end of each threaded spindle being secured to a rotary chuck, said rotary chucks having an external gear, the external gears being connected to one another via intermediate gear wheels, said rotary chucks and said intermediate gear wheels being arranged on a common support.

15. A warp drawing-in machine according to claim 8, wherein said threaded spindles are arranged on the upper edge of a respective carrier member so that the threaded spindle passes through an apertured portion of the drop wires carried by the respective carrier member.

* * * * *